United States Patent [19]

Worst

[11] 4,003,225

[45] Jan. 18, 1977

[54] LINT FILTER FOR AUTOMATIC WASHER

[75] Inventor: Joseph C. Worst, Louisville, Ky.

[73] Assignee: General Electric Company, Louisville, Ky.

[22] Filed: Jan. 7, 1976

[21] Appl. No.: 646,984

[52] U.S. Cl. ..... 68/18 FA
[51] Int. Cl.[2] ..... D06F 39/10
[58] Field of Search ..... 68/18 FA

[56] References Cited

UNITED STATES PATENTS

| | | | |
|---|---|---|---|
| 2,744,402 | 5/1956 | Smith | 68/181 FA X |
| 2,976,711 | 3/1961 | Smith | 68/17 A |
| 3,027,742 | 4/1962 | Nowicki | 68/18 FA |

*Primary Examiner*—Philip R. Coe

*Attorney, Agent, or Firm*—Frederick P. Weidner; Francis H. Boos

[57] ABSTRACT

A lint filter agitator assembly for an automatic washing machine having a driving member, an agitator secured to the driving member. The agitator has an upper center post, a lower flared base portion, and at least two agitating vanes. There is provided a filter member mounted on the exterior of the agitator in the area of the flared base portion and recessed between the two agitator vanes. The filter member and agitator form a filtering chamber. Washing liquid is circulated through holes provided in the top of the filter member and exits through openings in the bottom of the filter member while any lint carried by the washing liquid is retained within the chamber.

9 Claims, 6 Drawing Figures

LINT FILTER FOR AUTOMATIC WASHER

BACKGROUND OF THE INVENTION

1. Field of the Invention:

The present invention relates to an automatic clothes washing machine, and, in particular, to a lint filter for use in an automatic washing machine.

2. Description of the Prior Art:

It is desirable, in an automatic washing machine, to provide means for the removal of lint from the liquid during the washing operation. To this end, various lint filter devices have been utilized in the past.

The prior art teaches the use of lint filters incorporated in the vaned agitator which vaned agitator causes the washing liquid to be circulated and flow through the filtering device. Examples of such filtering devices are shown in U.S. Pat. Nos. 2,744,402 and 2,976,711. Cleaning of such filtering devices, however, has been accomplished by removing the agitator from the machine and then somehow cleaning the filter and subsequently replacing the agitator in the machine. This is a laborious but necessary task if the filter is to continue functioning properly. In addition, it is highly desirable to have the lint filter visible to the machine operator and not buried under the agitator so that the operator will be reminded to clean the filter as needed. Otherwise, there is a tendency to not clean the filter thus drastically reducing the lint gathering quality.

By my invention I have improved the prior art lint filters in that I have provided a filter agitator assembly that may be cleaned without removing the agitator and the filter is positioned to be readily visible to the machine operator so that there is a visible indication that the filter needs to be cleaned.

SUMMARY OF THE INVENTION

In accordance with the present invention, a lint filter agitator assembly is provided for a washing machine which is adapted to be submerged in a body of washing liquid and oscillated therein to effect a cleansing of fabrics placed in the liquid. Included is a driving member and an agitator secured to the driving member having an upper centerpost, a lower flared base portion, at least two agitating vanes carried on the flanged base portion for agitating the fabrics within the liquid. Removably secured to the exterior of the agitator is a filter member which is mounted in the area of the flared base portion and recessed between the agitator vanes, the filter member and agitator forming a chamber therebetween. The filter member has a liquid inlet at the upper end toward the centerpost of the agitator to allow washing liquid into the chamber, the lower end has a liquid outlet to allow the washing liquid to exit the chamber, and lint retaining means for entrapping the lint in the chamber.

By the foregoing arrangement the washing liquid during the washing operation is caused to flow through the chamber formed by the agitator and the filter member and any lint carried in the liquid is retained inside the chamber by the lint retaining means. To clean the filter member it is simply removed from its securement to the agitator and the underside of the filter member containing the lint is cleaned and then the filter member is again secured to the agitator for the next washing operation.

DESCRIPTION OF THE PREFERRED EMBODIMENT

Figure 1:
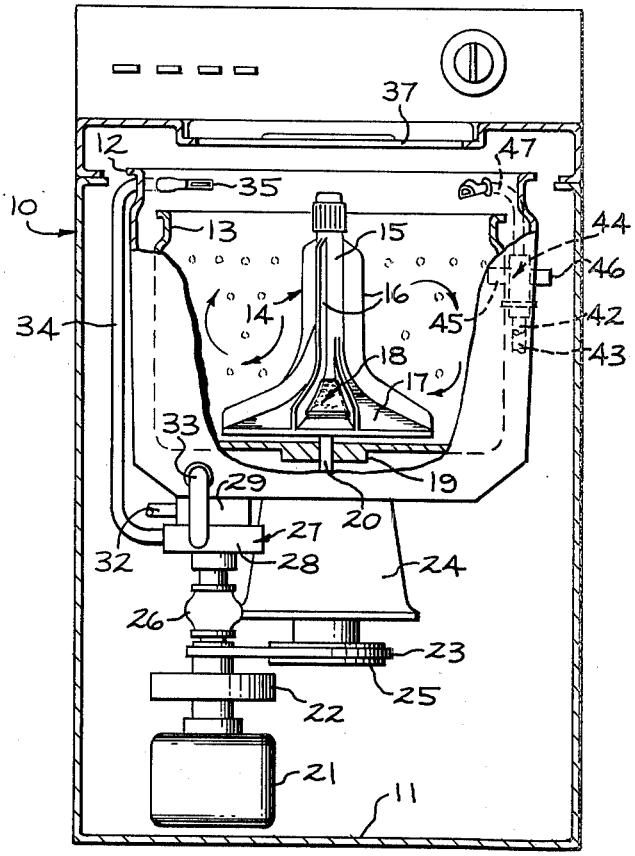
FIG. 1 is a schematic front elevational view of a clothes washing machine incorporating my invention, the view being partly broken away and partly in section.

Referring now to the drawing, and initially to FIG. 1 thereof, there is illustrated an agitator-type vertical-axis automatic clothes washer 10 having a supporting structure or load member 11. The washer may include the various operational components conventionally utilized in a domestic automatic washing machine, for instance, an imperforate tub 12 rigidly mounted within structure 11. Rotatably supported within tub 12 is a perforate washing basket 13 for washing and rinsing clothes therein and for centrifugally extracting liquid therefrom. At the center of basket 13 there is provided an agitator 14 which includes a center post 15 having a plurality of water or liquid circulating vanes 16 that extend at their lower end along and on top of an outwardly flared skirt 17. A removable filter member 18 is located between two of the vanes 16.

Both the clothes basket 13 and agitator 14 are rotatably mounted. The basket 13 is mounted on a hub 19 and the agitator 14 is mounted on a shaft 20 which extends upwardly through the hub 19 and through the center post 15 and is secured to the agitator so as to drive it. During one possible cycle of operation of the washer 10, fabrics, detergent and a predetermined quantity of liquid are introduced into the tub 12 and basket 13, and the agitator is then oscillated back and forth about its axis to move the clothes within the basket. After a predetermined period of this washing action, the agitator and basket are rotated in unison at high speed to centrifugally extract the washing liquid from the fabrics and discharge it to a drain (not shown). Following this extraction operation, a supply of clean liquid is introduced into the basket for rinsing the fabrics and the agitator is again oscillated. Finally, the agitator and basket are once more rotated in unison at high speed to extract the rinse liquid.

The basket 13 and agitator 14 may be driven by any suitable means. By way of example, I have shown them as driven by a reversible motor 21 through a drive mechanism including a clutch 22 mounted on the motor shaft. The motor is tailored so as to be used to its full extent when it accelerates the basket 13 to spin speed. In order to assist the motor during starting, clutch 22 allows the motor to start with less than a full load and then accept the full load as it comes up to speed. A suitable belt 23 transmits power from clutch 22 to a transmission assembly 24 through a pulley 25. Thus, depending upon the direction of motor rotation, the pulley 25 of transmission 24 is driven in opposite directions. The transmission 24 is so arranged that it supports and drives both the agitator drive shaft 20 and the basket mounting hub 19. When motor 21 is rotated in one direction, the transmission causes agitator 14 to oscillate and when motor 21 is driven in the opposite direction, the transmission causes the clothes basket 13 and agitator 14 to rotate together at high speed for centrifugal fluid extraction.

In addition to operating the transmission 24 as described, motor 21 also provides a direct drive through a flexible coupling 26 to a pump structure 27, which includes two separate pumping units 28 and 29 which are operated simultaneously in the same direction by motor 21. Pump unit 29 has an inlet connected to the tub 12 and an outlet connected by a conduit 32 to a suitable external drain (not shown). Pump 28 has an inlet connected by a conduit 33 to the interior of tub 12 and an outlet connected by conduit 34 to a nozzle 35 which is positioned to discharge, if desired, into an additive dispensing unit (not shown) which may be secured to the underneath side of an access lid 37. With this structure, then, when the motor 21 is operating so as to provide the washing mode or agitation, pump unit 28 draws liquid in from tub 12 and discharges it through conduit 34 into the basket. Conversely, when the motor is reversed so as to rotate the basket 13 and agitator 14 together at high speed to centrifugally extract fluid from fabrics in the basket, pump unit 29 will draw liquid from the tub and discharge it through conduit 32 to drain. Each of the pump units is substantially inoperative in the direction of rotation in which it is not used.

Hot and cold water may be applied to the machine through conduits 42 and 43 which are adapted to be connected respectively to sources of hot and cold water (not shown). Conduits 42 and 43 extend into a conventional mixing valve structure 44 having solenoids 45 and 46 and being connected to a hose 47. In a conventional manner selective or concurrent energization of solenoids 45 and 46 will provide the passage of hot, cold or warm water from the mixing valve 44 through the hose 47. Hose 47 is positioned to discharge into the basket 13 so that when one or both of solenoids 45 and 46 are energized, water enters basket 13 and tub 12.

In operation, the tub 12 and basket 13 are filled to some desired level with washing liquid. The oscillation of shaft 20 causes the agitator and vanes 16 to produce the desired washing operation within basket 13. The oscillation of vanes 16 also normally causes a separation of lint particles from the fabrics being washed within the fluid contained within the tub 12 and causes these particles to circulate within the body of liquid contained within the tub and become deposited on other fabrics unless they are separated from the washing liquid. It is these lint particles that the lint filter agitator assembly should remove from the washing liquid during the washing operation. During the oscillation motion of the vanes 16 the vane portions at the base of the agitator causes the washing liquid to be pumped and flow in the direction of the arrows shown in FIG. 1. While washing machine agitators have various configurations, the machines that utilize an oscillating back and forth motion of the agitator to effect the washing operation will have agitating vanes to accomplish the desired water flow and clothes turnover during that operation.

Figure 2:
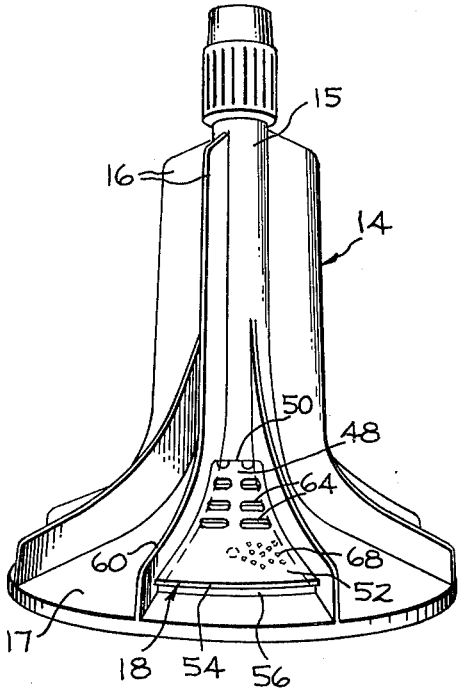
FIG. 2 is a perspective view of the filter agitator assembly of the present invention.
Figure 3:
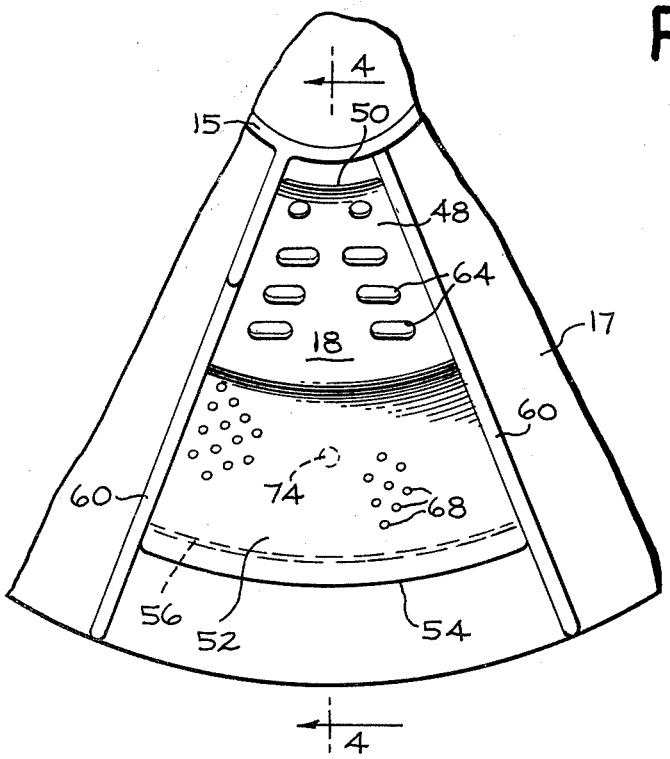
FIG. 3 is a fragmented top plan view of the filter agitator assembly of FIG. 2.
Figure 4:
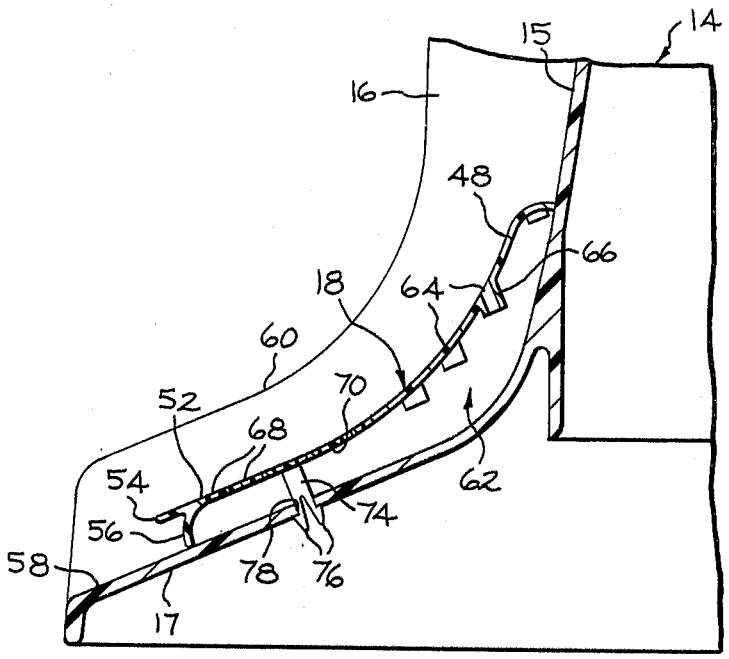
FIG. 4 is a cross sectional view taken along lines 4—4 of FIG. 3.

With particular reference to FIGS. 2, 3 and 4, the removable filter member 18 will be described. Since the agitator 14 has a flared skirt 17 joining the thinner centerpost portion 15 the filter member is pie-shaped so that it fits the contour of two adjacent vanes 16. The upper end 48 of the filter member 18 has its terminal end 50 in the form of a depending wall curved to accommodate the curvature of the centerpost 15 of the agitator 14. The terminal end 50 is curved inwardly to essentially abut the centerpost 15. The opposite end of the filter member, which is the lower end portion 52, carries a finger gripping lip 54 which as best seen in FIG. 4 is spaced outwardly of the agitator skirt 17. This spacing is to allow the machine operator to place his fingers between the lip 54 and the skirt 17, for manual removal of the filter member. The lower end portion 52 also carries a downwardly directed depending wall 56 which is dimensioned to abut the exterior surface 58 of the skirt 17. It should be noted that the depending wall 56 should be shaped to accommodate a close fit between it and the shape of the exterior surface 58 of the skirt 17. For good lint filtering characteristics, the filter member should be designed and dimensioned to snugly fit onto the agitator between two vanes 16 and be recessed below the upper edge 60 of the vanes 16. When the filter member is positioned on the agitator the filter member 18 and the exterior of the agitator 14 will form a chamber 62 through which the washing liquid will pass in order to be subjected to the filtering means as will be subsequently described.

The upper end portion 48 of the filter member 18 is provided with a plurality of rather large liquid inlet openings 64 to allow the washing liquid and any lint that it is carrying to flow through the liquid inlet openings into the chamber 62. The liquid inlet openings 64 are preferably provided with inwardly extending flanges 66 which surrounds the opening. The inwardly directed flanges 66 are desirable as they prevent any hangup of elongated lint particles or threads that may otherwise clog the openings.

The lower end portion 52 of the filter member 18 is provided with lint retaining means. FIG. 4 shows one such lint retaining means consisting of a plurality of relatively small openings 68 which allows the liquid in chamber 62 to exit that chamber through those openings, however, since they are relatively small, any lint being carried by the liquid is retained on the inner surface 70 of the filter member 18.

Figure 5:
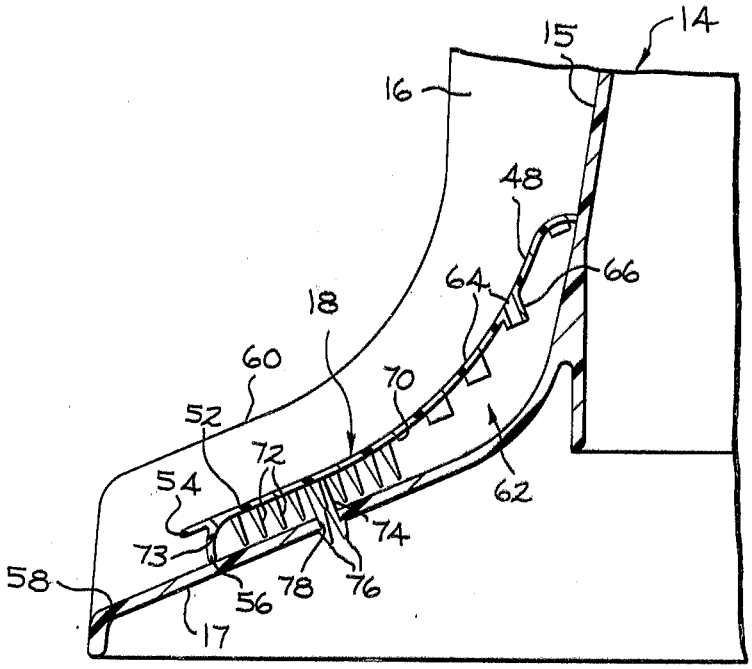
FIG. 5 is an alternate embodiment of the filter agitator assembly invention similar to that shown in FIG. 4.

An alternate embodiment of the filter member 18 is shown in FIG. 5 wherein the lint retaining means is a plurality of pins 72 protruding from the inner surface 70 of the filter member so that the washing liquid passing through the chamber flows through the pins and the pins thereby gather or trap the lint being carried by the liquid. The pins 72 should extend toward and terminate as close to the agitator skirt 17 as possible to subject as much of the washing liquid to the pins as possible, thus enhancing the filtering quality. For the liquid to leave the filtering chamber 62 outlet openings 73 may be provided near the lower end of the filter member such as in the depending wall 56.

If desired, both the small outlet openings 68 and the pins 72 may be used as the lint retaining means by using the embodiment shown in FIGS. 2–4 and placing the pins 72 between the outlet openings 68.

The filter member 18 may be retained in its operative position on the exterior of the agitator by any suitable means that will enable the filter member to be easily removable therefrom. As shown in the drawings, one such arrangement may be a hook-shaped latch member 74 such as one having bifurcated arms 76 that are biased apart once they are received in a latch opening 78 in the skirt 17 of the agitator. To remove the filter member the machine operator grips the lip 54 and by applying upward force, overcomes the bias force of the bifurcated arms thus removing the latch member 74 from the latch opening 76.

It will be noted from the foregoing that the lint filter agitator assembly is quite simple in structure and is readily removable in a very easy manner from within the washing machine for cleaning of the filter means. Also, because of its location the filter member is quite visible for easy detection by the machine operator of a condition requiring the filter to be cleaned. This would be particularly so if the filter member is made of transparent plastic. Moreover, by locating the filter member primarily on the skirt 17 of the agitator the filter will be submerged in the washing liquid during the washing operation even in instances where the liquid level may be quite low such as in the case of small loads of fabrics to be washed. Many automatic washing machines today provide for a low water level in those cases.

Figure 6:
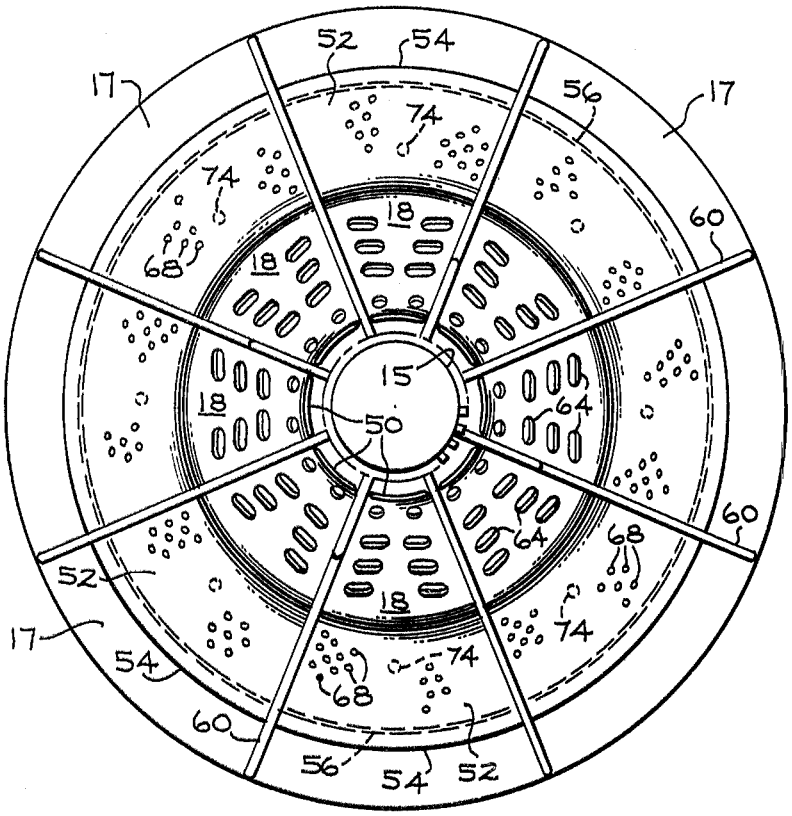
FIG. 6 is a top plan view of the filter agitator assembly of the present invention showing multiple filter members between each set of agitating vanes.

While FIGS. 1–5 show only one filter member secured between two vanes, it would be advantageous from an efficient filtering standpoint, that at least two such members be provided each between two separate sets of agitators vanes. Preferably these filtering members would be located on opposite sides of the agitator. FIG. 6 shows an embodiment wherein there is a separate filter member located between each separate set of agitator vanes.

The foregoing is a description of the preferred embodiment of the invention and variations may be made thereto without departing from the true spirit of the invention, as defined by the appended claims.

I claim:

1. A lint filter agitator assembly adapted to be submerged in a body of washing liquid and oscillated therein to effect a cleansing of fabrics placed within said liquid and entrapment of any lint in the washing liquid, comprising:

a. a driving member, b. an agitator secured to the driving member having an upper centerpost, a lower flared base portion, at least two agitating vanes carried on the flared base portion for agitating the fabrics within the liquid, and c. a removable filter member mounted on the exterior of the agitator in the area of the flared base portion and recessed between the agitator vanes, said filter member and agitator forming a chamber therebetween, said filter member having a liquid inlet at the upper end toward the centerpost to allow washing liquid into the chamber, a liquid outlet at the lower end to allow the washing liquid out of the chamber, and lint retaining means for retaining lint in the chamber.

2. The lint filter agitator assembly of Claim 1 wherein the liquid outlet and lint retaining means is a plurality of small openings.

3. The invention of Claim 2 wherein there is a plurality of pins between the small openings secured to and extending from the filter member into the chamber.

4. The lint filter agitator assembly of Claim 1 wherein there are at least two sets of agitating vanes and one removable filter member between each set of the agitating vanes.

5. The lint filter agitator assembly of claim 1 wherein the lint retaining means is a plurality of pins secured to and extending from the filter member into the chamber upstream of the liquid outlet.

6. The lint filter agitator assembly of claim 1 wherein the liquid inlet is formed with a flange directed into the chamber.

7. The lint filter agitator assembly of claim 1 wherein a finger gripping lip spaced outwardly of the agitator is formed at the lower end of the removable filter member.

8. The lint filter agitator assembly of claim 1 wherein the upper end and lower end have depending walls curved to accommodate the exterior surface of the agitator.

9. The lint filter agitator assembly of claim 1 wherein the filter member is mounted on the exterior of the agitator by a hook-shaped latch member attached to the filter member and being received in a latch opening in the skirt of the agitator.

* * * * *